United States Patent [19]

Weir et al.

[11] Patent Number: 4,610,724

[45] Date of Patent: Sep. 9, 1986

[54] RECOVERY OF GOLD FROM REFRACTORY AURIFEROUS IRON-CONTAINING SULPHIDIC MATERIAL

[75] Inventors: Donald R. Weir, Fort Saskatchewan; Roman M. Genik-Sas-Berezowsky, Edmonton, both of Canada

[73] Assignee: Sherritt Gordon Mines Limited, Toronto, Canada

[21] Appl. No.: 707,711

[22] Filed: Mar. 4, 1985

[30] Foreign Application Priority Data

Sep. 27, 1984 [CA] Canada ..... 464183

[51] Int. Cl.[4] ..... C22B 11/04

[52] U.S. Cl. ..... 75/118 R; 423/29; 423/30; 423/31; 423/42; 423/87; 423/140; 423/150; 75/2; 75/101 R; 75/105; 75/121; 204/110

[58] Field of Search ..... 423/27, 29, 30, 31, 423/150, 140, 87, 42; 75/105, 2, 101 R, 115, 108, 118 R, 121; 204/110

[56] References Cited

U.S. PATENT DOCUMENTS 4,038,362 7/1977 Guay ..... 423/29

4,266,972 5/1981 Redondo-Abad et al. ..... 423/41

4,304,644 12/1981 Victorovich et al. ..... 423/150

*Primary Examiner*—John Doll

*Assistant Examiner*—Robert L. Stoll

*Attorney, Agent, or Firm*—Robert F. Delbridge; Arne I. Fors

[57] ABSTRACT

A process for recovering gold from refractory auriferous iron containing sulphidic material which comprises treating an aqueous slurry of the material in a pressure oxidation step at a temperature in the range of from about 135° to about 250° C. under a total pressure of from about 500 to about 5000 kPa to oxidize sulphide sulphur to sulphate form and release gold from a refractory state. The pH of the resultant oxidized slurry is adjusted to a value suitable for cyanidation. The pH adjusted slurry is subjected to a cyanidation step in which gold is dissolved in a cyanide solution. The cyanided slurry is diluted to a pulp density in the range of from about 2 to about 10% solids by weight. The diluted slurry is subjected to a liquid-solids separation step to produce a gold containing solution and a relatively high pulp density gold-containing slurry, and gold from the gold-containing solution and from the high pulp density gold-containing slurry is separately recovered.

9 Claims, 1 Drawing Figure

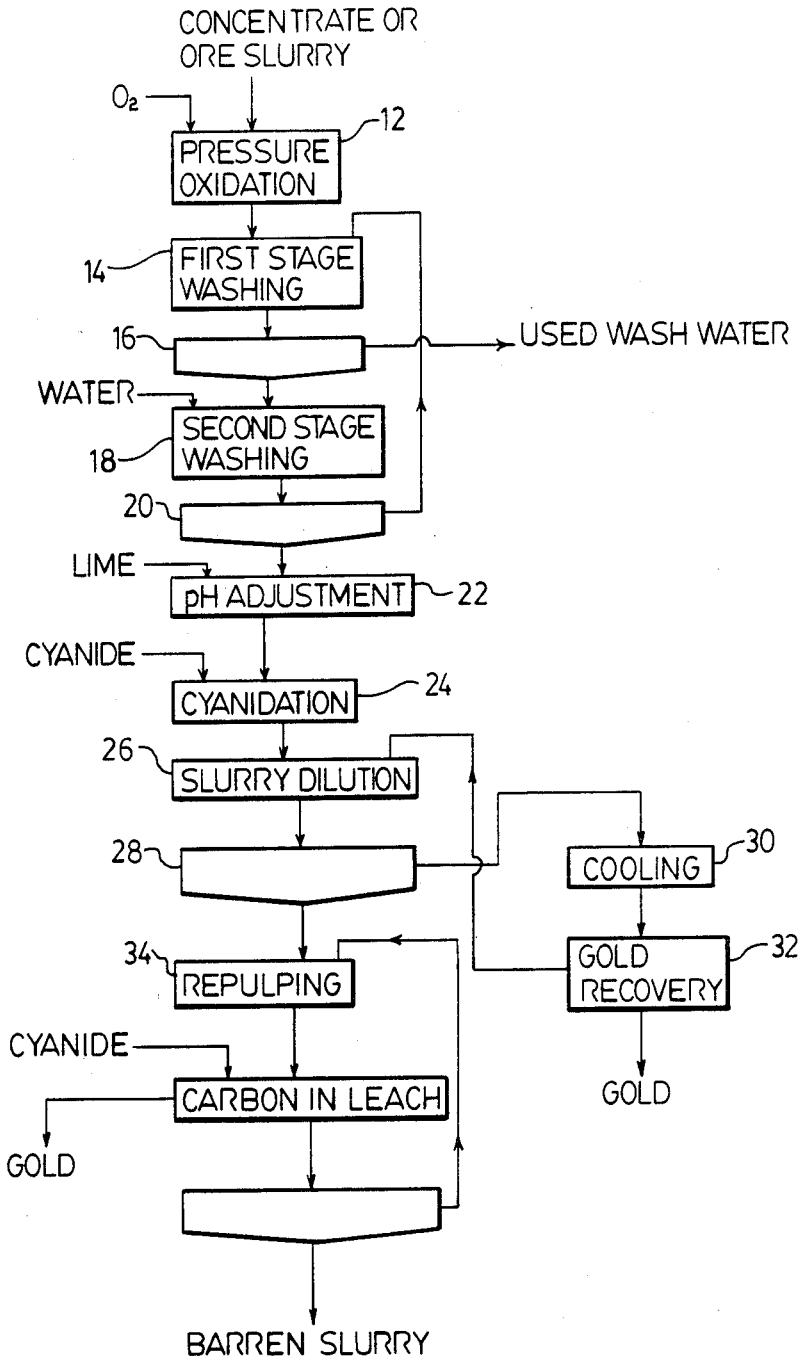
CONCENTRATE OR
ORE SLURRY
$O_2$
12
PRESSURE
OXIDATION
14
FIRST STAGE
WASHING
16
USED WASH WATER
WATER
SECOND STAGE
WASHING
18
20
LIME
pH ADJUSTMENT
22
CYANIDE
CYANIDATION
24
26
SLURRY DILUTION
28
COOLING
30
34
REPULPING
GOLD
RECOVERY
32
CYANIDE
CARBON IN LEACH
GOLD
GOLD
BARREN SLURRY

RECOVERY OF GOLD FROM REFRACTORY AURIFEROUS IRON-CONTAINING SULPHIDIC MATERIAL

This invention relates to the recovery of gold from refractory auriferous iron-containing sulphidic material, which may for example be ore or concentrate.

It is known that it is desirable to subject refractory auriferous iron-containing sulphidic material to a pressure oxidation step to release gold from a refractory state before recovering gold by cyanidation, see for example U.S. Pat. No. 2,777,764 (Hedley et al) issued Jan. 15, 1957. Retention times normally used in conventional cyanidation practice are generally around 24 hours to ensure good gold recovery, although they may be from about 12 to 72 hours depending on the nature of the feed solids.

The present invention is based on the discovery that, after pressure oxidation treatment, the gold content of refractory auriferous iron-containing sulphidic material (usually comprising arsenopyrite and/or pyrite) responds rapidly to extraction by cyanidation. In some cases, it has been found that up to about 96% of the extractable gold may be extracted by cyanidation in 1 hour or less, and sometimes in half an hour or less. Further, after such rapid cyanidation, the present invention utilizes the discovery that gold can be efficiently removed from the cyanide slurry by diluting the slurry to a relatively low pulp density, subjecting the diluted slurry to a liquid-solids separation step to produce a gold-containing solution and a relatively high pulp density slurry, and separately recovering gold from the gold-containing solution and the high pulp density slurry.

The present invention accordingly provides a process for recovering gold from refractory auriferous iron-containing sulphidic material comprising treating an aqueous slurry of the material in a pressure oxidation step at a temperature in the range of from about 135° to about 250° C., preferably from about 160° to about 200° C., under a total pressure of from about 500 to about 5000 kPa to oxidize sulphide sulphur to sulphate form and release gold from a refractory state, adjusting the pH of the resultant oxidized slurry to a value suitable for cyanidation, subjecting the pH adjusted slurry to a cyanidation solution, diluting the cyanided slurry to a pulp density in the range of from about 2 to about 10% solids by weight, subjecting the diluted slurry to a liquid-solids separation step to produce a gold containing solution and a relatively high pulp density gold-containing slurry, and separately recovering gold from the gold-containing solution and from the high pulp density gold-containing slurry.

Advantageously, the oxidized slurry is washed prior to the pH adjustment step to remove soluble iron, arsenic, and sulphate.

Gold may be recovered from the gold containing solution by adsorption by activated carbon or by an ion exchange resin. Gold may be recovered from the high pulp density slurry by adsorption by activated carbon in a carbon in leach or carbon in pulp circuit.

The relatively high pulp density gold-containing slurry may have a pulp density in the range of from about 45 to about 60% solids by weight or preferably from about 35 to about 45%.

One embodiment of the invention will now be described by way of example, with reference to the accompanying drawing which shows a schematic flow diagram of a process for recovering gold from a refractory auriferous iron-containing sulphidic material.

Referring to the drawing, the refractory auriferous iron-containing sulphidic material to be treated will usually contain arsenopyrite and/or pyrite, and the ore or a suitable concentrate may be treated. The ore or concentrate is ground to about 80% less than 200 mesh and supplied as an aqueous slurry to a pressure oxidation step 12 where the material is treated at a temperature of from about 160° to about 200° C. under a total pressure of from about 700 to about 5000 kPa to oxidize substantially all the sulphate sulphur to sulphate form and liberate gold from the refractory step. During the pressure oxidation step, the solids undergo further size reduction, particularly sulphides containing refractory gold. The sulphides are substantially completely destroyed during the oxidation since the arsenic, iron and sulphur are dissolved. A significant portion of the arsenic and iron, and to a lesser extent the sulphur (as sulphate), may substantially be precipitated, but such solids are extremely fine and are precipitated externally to the gold particles, rendering the gold more easily recoverable.

The hot oxidized slurry passes to the first stage of a two-stage countercurrent decantation washing step comprising a first stage 14, first stage thickener 16, second stage 18, and second stage thickener 20. In the first stage 14, the hot oxidized slurry is washed with overflow from the second stage thickener 18, and the washed slurry passes to the first stage thickener 16 from which used wash water is removed as overflow. The washed solids are recovered as underflow and passed to the second wash stage 18 where fresh wash water is added. The washed slurry passes to the second stage thickener 20 from which wash water removed as overflow is recycled to the first wash stage 14 as previously mentioned, with washed solids being removed as underflow.

This washing step removes soluble iron, arsenic and sulphate, thereby reducing lime requirements and the likelihood of slime precipitation in the subequent pH adjustment step to be described, and also removes cyanicides liberated in the pressure oxidation step 12. The washing step also serves to reduce the temperature of the slurry to a temperature in the range of from about 40° to about 70° C.

The washed, thickened slurry then proceeds to pH adjustment step 22 where lime is added to raise the pH of the slurry to a value suitable for cyanidation, usually in the range of from about 9 to about 11, for example about 10.5.

The pH adjustment slurry is then subjected to a single stage or possible two stage cyanidation step 24. In accordance with the invention, retention time is short, and the vessel or vessels used may be considerably smaller than in conventional practice. Also, the vessel or vessels may be closed to take advantage of improved cyanidation leach rates at elevated temperatures without incurring undesirable loss of cyanide as vapour. Conventional cyanidation is carried out at ambient temperatures, usually 20° to 35° C. for this reason. Air requirements are minimal and air sparging may not be required, further lowering cyanide loss. As mentioned above, the bulk of the cyanicides were removed in the wash stages 14, 18. The cyanidation may be conducted in stirred tanks or in a tube reactor at higher pulp densities than are possible in conventional stirred tanks.

After the cyanidation step 24, the slurry passes to a dilution step 26 where the slurry is cooled and diluted to less than about 10% solids by weight, and preferably to less than about 5% solids with barren cyanide solution from a gold recovery step to be described later. The diluted slurry then proceeds to a thickener 28, from which the overflow containing a major proportion of the feed gold is passed to a cooling step 30 and then to a gold recovery step 32.

In the gold recovery step 32, the gold-containing solution is passed through a column or a series of beds containing activated carbon or ion exchange resin which adsorbs gold. The gold depleted cyanide solution from the gold recovery step 32 is utilized in the slurry dilution step 26. The preliminary cooling step 30 serves to enhance the loading characteristics of the gold onto the activated carbon or ion exchange resin in the gold recovery step 32, and also results in a cooler barren cyanide solution which consequently effects cooling in the slurry dilution step 26. This also produces advantageous cooling for the subsequent carbon in leach circuit to be described.

The dilution step 26 is in fact a wash/repulp step, at a high wash ratio, thereby enabling recovery of the major portion of the dissolved gold in the primary recovery step 32. The heavy dilution of the cyanided slurry in the dilution step 26 results in improved flocculation in the thickener 28, reducing thickener requirements and enabling slurry underflow containing from about 45 to 60% solids to be readily achieved. The underflow from the thickener 28 is diluted in repulping step 34 with barren cyanide solution from the carbon in leach step to be described, to a pulp density in the range of from about 35 to about 45% solids by weight, providing further cooling.

The diluted underflow slurry is then processed through a carbon in leach circuit 36 having from about 4 to 8 stages for the recovery of the remaining soluble gold, the gold which has been adsorbed by residue slimes, and additional leaching and adsorption of unextracted gold. Thus, there may be one or two cyanidation leaching stages followed by up to 7 stages which contain carbon. The retention times and/or the number of stages in the carbon in leach circuit 36 can be greatly reduced compared to conventional practice since the characteristics of the solids being treated favour more rapid leaching of the gold and since the major portion of the recoverable gold has been removed as overflow from the thickener 28. Barren slurry from the carbon in leach circuit 36 is thickened prior to disposal for recovery of cyanide bearing solution for recycle to repulping step 34.

It will be noted that only the carbon utilized in the carbon in leach circuit 36 is contacted with slurry, thereby minimizing the fouling of carbon by residue fines and slimes, with the result that carbon regeneration or cleaning (for example by acid washing and/or thermal reactivation) requirements are reduced. The carbon (and/or ion exchange resin) used in the gold recovery step 32 is less subject to fouling by slimes and loading with contaminants, since most of the common impurities have been removed in the pressure oxidation and wash steps 12, 14, 18. This makes is possible to achieve relatively high gold loadings on the carbon in the gold recovery step 32, so that direct smelting or burning of the loaded carbon becomes an economically attractive alternative to stripping and electrowinning or zinc precipitation of the gold from the stripped solution followed by regeneration of carbon.

An example of the invention will now be described.

EXAMPLE

A refractory auriferous iron-containing sulphidic concentrate contained 228 g/t Au, 41 g/t Ag and by weight 7.0% As, 24.7% Fe and 18% S, The concentrate was pressure oxidized at a pulp density of about 16% under a total pressure of 1475 kPa at a temperature of 185° C. with a retention time of 2 hours. The autoclave discharge slurry proceeded through 2 stages of countercurrent decantation washing. The thickened washed oxidized solids were then fed as a slurry with a pulp density of about 51% solids to a pH adjustment step where the slurry was limed through about pH 11 and diluted to 35 to 38% solids.

The pH adjusted slurry was then leached with sodium cyanide solution from about 4 h, and the cyanided slurry diluted to a pulp density of about 2.5% solids by weight with barren solution from a gold recovery step. The diluted slurry was thickened, with the underflow being in the 45 to 51% solids range. The gold was recovered from the overflow by carbon adsorption, with subsequent stripping by NaCN/NaOH solution and cementation of gold and silver with zinc dust. The underflow slurry was diluted to about 30% solids by recycle, and gold was recovered in the carbon in leach step. It was found that about 94.5% of the extractable gold was recovered from the thickener overflow in the gold recovery step, with the remaining 5.5% being recovered from the thickener underflow in the carbon in leach step.

Other examples and embodiments will be readily apparent to a person skilled in the art, the scope of the invention being defined in the appended claims.

What we claim as new and desire to protect by Letters Patent of the United States is:

1. A process for recovering gold from refractory auriferous iron-containing sulphidic material comprising:

treating an aqueous slurry of the material in a pressure oxidation step at a temperature in the range of from about 135° to about 250° C. under a total pressure of from about 500 to about 5000 kPa to oxidize sulphide sulphur to sulphate form and release gold from a refractory state, adjusting the pH of the resultant oxidized slurry to a value suitable for cyanidation, subjecting the pH adjusted slurry to a cyanidation step in which gold is dissolved in a cyanide solution, diluting the cyanided slurry to a pulp density in the range of from about 2 to about 10% solids by weight, subjecting the diluted slurry to a liquid-solids separation step to produce a gold containing solution and a relatively high pulp density gold-containing slurry, and separately recovering gold from the gold-containing solution and from the high pulp density gold-containing slurry.

2. A process according to claim 1 including washing the oxidized slurry prior to the pH adjustment step to remove soluble iron, arsenic if present and sulphate.

3. A process according to claim 1 including recovering gold from the gold containing solution by adsorption by activated carbon.

4. A process according to claim 1 including removing gold from the gold-containing solution by adsorption by an ion exchange resin.

5. A process according to claim 1 including recovering gold from the high pulp density slurry by adsorption by activated carbon.

6. A process according to claim 1 wherein the relatively high pulp density gold-containing slurry has a pulp density in the range of from about 45 to about 60% solids by weight.

7. A process according to claim 1 including diluting the resultant high pulp density slurry to a pulp density of from about 35 to about 45% solids by weight before removing gold therefrom.

8. A process according to claim 1 wherein the pressure oxidation step is carried out at a temperature in the range of from about 160° to about 200° C.

9. A process according to claim 1 wherein the cyanided slurry is diluted by barren solution produced after recovery of gold from the gold-containing solution.

* * * * *